US011314184B2

(12) United States Patent
Hasegawa et al.

(10) Patent No.: US 11,314,184 B2
(45) Date of Patent: Apr. 26, 2022

(54) IMAGE FORMING APPARATUS, IMAGE FORMING METHOD, AND DATA RECORDING MEDIUM

(71) Applicant: Ricoh Company, Ltd., Tokyo (JP)

(72) Inventors: Kei Hasegawa, Kanagawa (JP); Keiji Kunimi, Kanagawa (JP); Kyoko Takeguchi, Yamaguchi (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/239,810

(22) Filed: Apr. 26, 2021

(65) Prior Publication Data

US 2021/0349410 A1 Nov. 11, 2021

(30) Foreign Application Priority Data

May 7, 2020 (JP) ..... JP2020-082085
Oct. 6, 2020 (JP) ..... JP2020-169368

(51) Int. Cl.
*G03G 15/08* (2006.01)
*G03G 15/00* (2006.01)
*G03G 15/20* (2006.01)

(52) U.S. Cl.
CPC ..... *G03G 15/0865* (2013.01); *G03G 15/2007* (2013.01); *G03G 15/5062* (2013.01); *G03G 2215/00037* (2013.01)

(58) Field of Classification Search
CPC ..... G03G 15/2007; G03G 2215/00037
See application file for complete search history.

(56) References Cited

U.S. PATENT DOCUMENTS

2015/0063865 A1 3/2015 Furuichi et al.
2018/0267452 A1 9/2018 Aoki et al.

FOREIGN PATENT DOCUMENTS

| | | | | |
|---|---|---|---|---|
| CN | 109976121 A | * | 7/2019 | ..... G03G 9/09 |
| JP | 10-000882 | | 1/1998 | |
| JP | 2005-161792 | | 6/2005 | |
| JP | 2007-003944 | | 1/2007 | |
| JP | 2012-224017 | | 11/2012 | |
| JP | 2013-001077 | | 1/2013 | |
| JP | 2015-21 9407 | | 12/2015 | |

* cited by examiner

*Primary Examiner* — Victor Verbitsky
(74) *Attorney, Agent, or Firm* — Xsensus LLP

(57) ABSTRACT

A method of forming an image includes forming, on a recording medium (P), a special-light responsive image (201) that includes an image forming material including a special-light responsive image forming material that reacts to special light other than visible light and a special-light irresponsive image (202) that includes an image forming material including the special-light responsive image forming material. The special-light responsive image forming material of the special-light irresponsive image (202) is less than the special-light responsive image forming material of the special-light responsive image (201), and the special-light irresponsive image (202) is a prevention image that prevents visibility of the special-light responsive image (201). The forming includes forming an overlaid portion (203) in which at least a portion of one of the prevention image and the special-light responsive image (201) is overlaid on top of another one of the prevention image and the special-light responsive image (201).

20 Claims, 6 Drawing Sheets

IMAGE FORMING APPARATUS, IMAGE FORMING METHOD, AND DATA RECORDING MEDIUM

CROSS-REFERENCE TO RELATED APPLICATIONS

This patent application is based on and claims priority pursuant to 35 U.S.C. § 119(a) to Japanese Patent Application Nos. 2020-082085 and 2020-169368, filed on May 7, 2020, and Oct. 6, 2020, respectively, in the Japan Patent Office, the entire disclosures of which are hereby incorporated by reference herein.

BACKGROUND

Technical Field

Embodiments of the present disclosure relate to an image forming apparatus, an image forming method, and a data recording medium.

Background Art

In the related art, image forming apparatuses are known that can form a special-light responsive image including a special-light responsive image forming material that reacts to special light other than visible light and a special-light irresponsive image including the special-light responsive image forming material less than the special-light responsive image.

The above image forming apparatus is known to print a special-light responsive image onto a recording medium using black toner that serves as a special-light responsive image forming material and has infrared light absorption characteristics, and print a concealing layer as a background image of the special-light responsive image, which serves as a prevention image, using an infrared light non-absorbing material that has the same color as that of the special-light responsive image and serves as a special-light irresponsive image forming material.

According to the related art, a special-light responsive image can be concealed so as to be invisible by printing a concealing layer whose color is same as that of the special-light responsive image as a background image of the special-light responsive image. Moreover, in the related art, the concealing layer is printed so as not to overlap with the special-light responsive image, the surface of a recording medium onto which an image is to be printed are free from projections or depressions and are smoothly flat.

SUMMARY

Embodiments of the present disclosure described herein provide three methods of forming an image. The first method includes forming, on a recording medium, a special-light responsive image that includes an image forming material including a special-light responsive image forming material that reacts to special light other than visible light and a special-light irresponsive image that includes an image forming material including the special-light responsive image forming material. The special-light responsive image forming material of the special-light irresponsive image is less than the special-light responsive image forming material of the special-light responsive image, and the special-light irresponsive image is a prevention image that prevents visibility of the special-light responsive image. The forming includes forming an overlaid portion in which at least a portion of one of the prevention image and the special-light responsive image is overlaid on top of another one of the prevention image and the special-light responsive image, and density of adherence of the image forming material in the overlaid portion is smaller than density of adherence of the image forming material in a non-overlaid portion in which one of the prevention image and the special-light responsive image is not overlaid on top of another one of the prevention image and the special-light responsive image. The second method of forming an image includes forming, on a recording medium, a special-light responsive image that includes an image forming material including a special-light responsive image forming material that reacts to special light other than visible light and a special-light irresponsive image that includes an image forming material including the special-light responsive image forming material. In the second method, the special-light responsive image forming material of the special-light irresponsive image is less than the special-light responsive image forming material of the special-light responsive image, and the special-light irresponsive image is a prevention image that prevents visibility of the special-light responsive image. Moreover, in the second method, the prevention image and the special-light responsive image are overlaid on top of each other only at an edge face of the prevention image or an area within a prescribed range from the edge face of the prevention image and an edge face of the special-light responsive image or an area within a prescribed range from the edge face of the special-light responsive image. The third method includes forming, on a recording medium, a special-light responsive image that includes an image forming material including a special-light responsive image forming material that reacts to special light other than visible light and a special-light irresponsive image that includes an image forming material including the special-light responsive image forming material, forming a mixed image around the special-light responsive image, the mixed image including the special-light responsive image forming material less than the special-light responsive image forming material of the special-light responsive image and more than the special-light responsive image forming material of the special-light irresponsive image, and forming the special-light irresponsive image around the mixed image. In the third method, the special-light responsive image forming material of the special-light irresponsive image is less than the special-light responsive image forming material of the special-light responsive image.

BRIEF DESCRIPTION OF THE DRAWINGS

A more complete appreciation of embodiments and the many attendant advantages thereof will be readily obtained as the same becomes better understood by reference to the following detailed description when considered in connection with the accompanying drawings.

Figure 1:
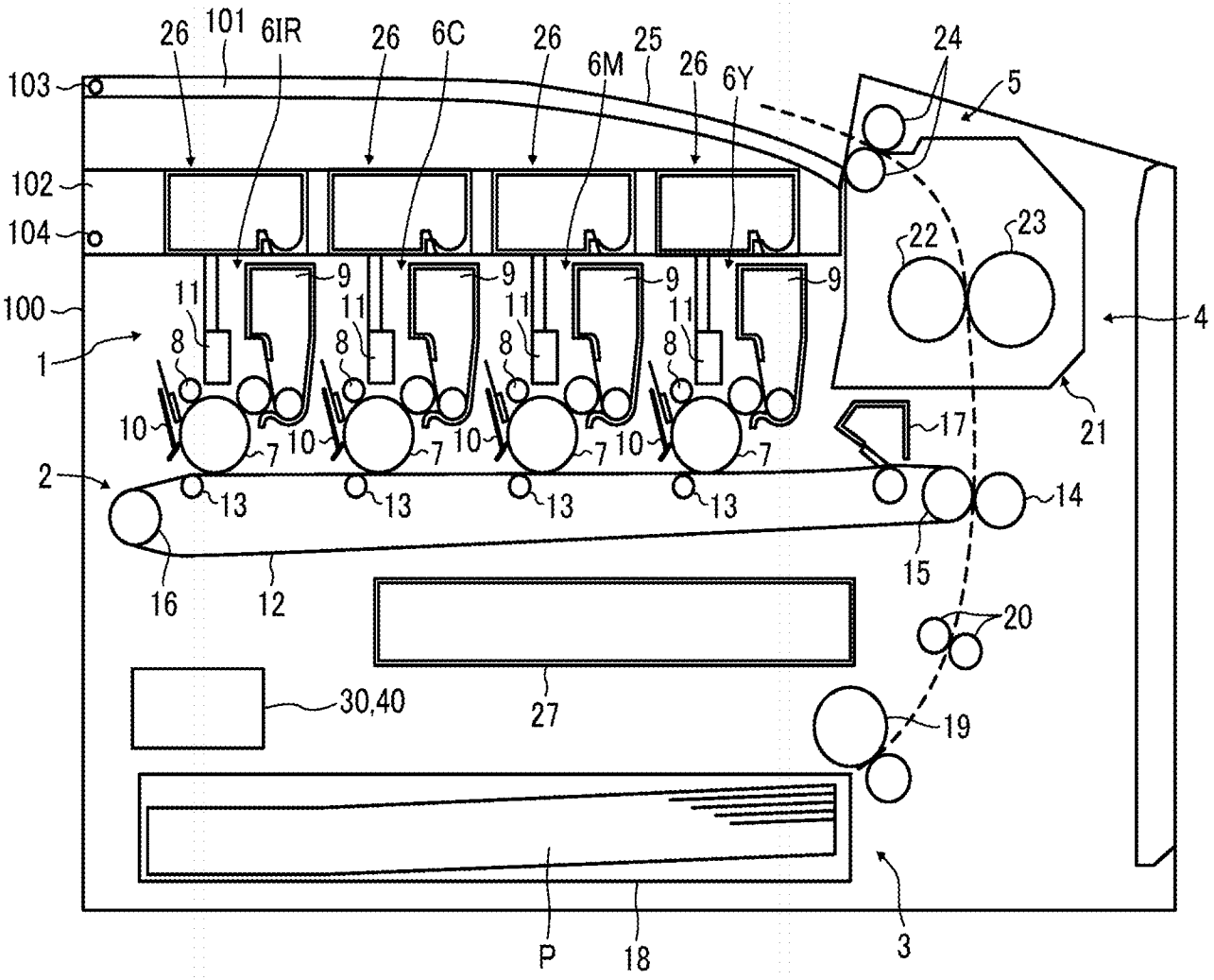
FIG. 1 is a diagram illustrating a schematic configuration of a printer according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that have the same structure, operate in a similar manner, and achieve a similar result.

In the following description, illustrative embodiments will be described with reference to acts and symbolic representations of operations (e.g., in the form of flowcharts) that may be implemented as program modules or functional processes including routines, programs, objects, components, data structures, etc., that perform particular tasks or implement particular abstract data types and may be implemented using existing hardware at existing network elements or control nodes. Such existing hardware may include one or more central processing units (CPUs), digital signal processors (DSPs), application-specific integrated circuits (ASICs), field-programmable gate arrays (FPGAs), computers or the like. These terms may be collectively referred to as processors.

Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

A color printer, which serves as an image forming apparatus, to which a method according to an embodiment of the present disclosure is applied is described below with reference to the accompanying drawings. Such a color printer according to the present embodiment will be referred to simply as a printer in the following description.

In the present embodiment, the apparatus according to an embodiment of the present disclosure is applied to an image forming apparatus with four or less stations. The image forming apparatus according to the present embodiment is satisfactory as long as it can form an invisible image onto a recording medium using special toner that forms an invisible image. In other words, the apparatus according to an embodiment of the present disclosure may be applied not only to a printer but also to a copier alone, facsimile (FAX) alone, or a multifunction peripheral (MFP) that has at least two functions of a printer, a copier, a facsimile, and a scanner.

The printer according to the present embodiment uses a special toner to form an invisible image. For example, such a special toner is used to embed additional information onto a visible image. For the purposes of preventing illegal copy or the like, a special toner is used when an invisible image, for example, a textual image such as the image of "COPY" that cannot visually be recognized by human eyes, is to be formed on a recording medium together with a visible image that is formed by color toner. Such an invisible image may also be referred to as, for example, invisible patterns and a ground tint. Alternatively, a special toner may be used when a coded image made of a visible image and a coded image made of an invisible image are to be formed on a recording medium in an overlapping manner for the purposes of increasing the amount of information of a coded image such as a bar code image or a quick response (QR) code (registered trademark) image. In some embodiments, a special toner may be used when only an invisible image is to be formed on a recording medium and no visible image is to be formed.

As will be described later in detail, an invisible image according to the present embodiment is formed by toner whose transparency is higher than the transparency of normal color toner under visible light, and is made visible as, for example, light emission and color reproduction are performed by the irradiation with infrared light or the like.

As special toner that serves as a special-light responsive image forming material, for example, infrared light absorption toner that has transparency, and fluorescent toner that has transparency and emits fluorescent light when irradiated with ultraviolet (UV) light are known in the art. Such toner absorbs the light outside the optical range of visible light or emits light within the optical range of visible light in response to the light outside the optical range of visible light is known in the art. In the present embodiment, infrared light absorption toner is used as special toner. In the following description, reference signs are used for some components of the apparatus according to the present embodiment. In particular, yellow toner, magenta toner, cyan toner, and infrared light absorption toner may be referred to as Y (Y toner), M (M toner), C (C toner), and IR (IR toner), respectively. Moreover, it is desired that clear toner with transparency be used as special toner. The color reproduction of such toner is controlled under visible light. Note also that such clear toner contains a less amount of pigment than normal color toner that serves as special-light irresponsive image forming material.

A special-light responsive image according to the present embodiment contains a larger amount of infrared light absorber than a special-light irresponsive image per each unit of dimension. In order to form a special-light responsive image, infrared light absorption toner (IR toner) that forms a special-light responsive image is configured to contain more infrared light absorber that serves as a special-light responsive image forming material than the color toner that forms a special-light irresponsive image.

In particular, preferably, the transmittance of infrared light of infrared light absorption toner (IR toner) that forms a special-light responsive image according to the present embodiment when a solid image is to be printed is equal to or less than 40%, and the transmittance of infrared light of normal color toner that forms a special-light irresponsive image is equal to or greater than 60%. Note also that both inorganic materials and organic materials may be used as infrared light absorber that makes up infrared light absorption toner (IR toner).

Previously, various kinds of infrared light absorber that has transparency and is used to achieve invisibility are under study to implement technologies to embed additional data, and various kinds of materials have been proposed. For example, inorganic materials including rare-earth metal such as ytterbium (Yb) and infrared light absorber having copper phosphoric acid crystallized glass are known in the art. Moreover, organic materials including, for example, aluminum compound and croconium pigment are known in the art, and organic materials including infrared light absorber, which have the maximum wavelength for spectral absorption at 750 to 1100 nanometers (nm), have been suggested. The absorbance of such organic materials at the wavelength of 650 nanometers (nm) is equal to or smaller than 5% of the absorbance at the maximum wavelength for spectral absorption. Furthermore, the usage of naphthalocyanine pigment has been proposed, and naphthalocyanine pigment is advantageous in difference between the absorbance of visible light and the absorbance of infrared light.

An infrared light absorber of inorganic materials may be, for example, a glass obtained by adding transition metal ion or a material such as a pigment composed of at least one of inorganic compound and organic compound to a known glass mesh forming material such as phosphoric acid, silica, and boric acid that transmits the light of wavelengths within a visible range, and a crystallized glass obtained by crystallizing the obtained glass with heat treatment. As such inorganic materials reflect the light within a visible area as desired, an invisible image can be obtained.

An infrared light absorber of organic materials may be, for example, colored materials such as phthalocyanine compounds and anthraquinone compounds and colorless materials such as aluminum salt compounds and naphthalocyanine compounds. Among these materials, colorless materials are preferred. This is because colorless materials do not color the image when the colorless materials are added, and the amount of colorless materials to be added is relatively small as the absorbing power for the range of infrared light is sufficiently large. In most cases, colorless materials do not impair the image quality of the color image. In particular, naphthalocyanine compounds are preferred from among several kinds of colorless materials. This is because naphthalocyanine compounds have very low absorbance for the range of visible light and are characterized by its absolute colorlessness. Further, naphthalocyanine compounds have little influence on the electrical charge of toner.

Secondly, the schematic configuration or operation of the printer according to the present embodiment is described below.

FIG. 1 is a diagram illustrating a schematic configuration of the printer according to the present embodiment.

The printer according to the present embodiment includes, for example, an image forming unit 1, a transfer unit 2, a recording medium supply unit 3, a fixing device 4, a recording medium ejection unit 5, a controller 30, an image formation controller 40.

The image forming unit 1 is provided with four processing units 6Y, 6M, 6C, and 6IR that serve as a set of image forming units. The configuration or structure of the four processing units 6Y, 6M, 6C, and 6IR is equivalent to each other except that different types of toner are used in each one of the four processing units 6Y, 6M, 6C, and 61R. In the present embodiment, a processing unit that uses black toner (K) is not provided as a part of the image forming units. Accordingly, a color image or a monochrome image is formed using color toner of Y, M, and C only. A processing unit that uses black toner (K) may be added as a part of the image forming units. However, such a configuration could be disadvantageous because size of the apparatus tends to increase.

The processing unit 61R that uses IR toner may be configured in a detachable manner, or the printer according to the present embodiment may be configured such that a processing unit that uses K toner may be installed instead of the processing unit that uses the IR toner. In such a configuration, a processing unit of K toner may be mounted when an image is to be formed without using the IR toner. By so doing, a color image or a monochrome image can be formed using Y, M, and C color toner and K color toner.

Alternatively, all processing units may be made removable, and the positions at which these processing units are installed may be interchanged with each other. In such a configuration, the positions of the processing unit that uses IR toner may be interchanged to switch the relative positions of the IR toner image and the multiple color toner image, i.e., the relative positions of the IR toner image and the multiple color toner image in the toner-image stacking direction, on a recording medium on an as-needed basis.

In the present embodiment, each one the four processing units 6Y, 6M, 6C, and 61R includes, for example, a photoconductor 7 that serves as a latent-image bearer and bears a latent image, a charging roller 8 that serves as a charger and evenly charges the surface of the photoconductor 7, a developing device 9 that serves as a developing unit and develops a latent image on the surface of the photoconductor 7, and a photoconductor cleaner 10 that serves as a latent-image bearer cleaning unit and cleans the surface of the photoconductor 7. A plurality of exposure devices 11 that serve as latent image forming units and form a latent image on the surfaces of the photoconductors 7 are arranged at positions facing the multiple photoconductors 7. In the present embodiment, a light-emitting diode (LED) unit is used as the exposure device 11. However, no limitation is indicated thereby, and a laser-beam scanning exposure device that uses laser diodes may be adopted.

In the transfer unit 2, a seamless intermediate transfer belt 12 that serves as an intermediate transferor and is a belt onto which the toner image on the photoconductor 7 is transferred, a plurality of primary transfer rollers 13 that serve as primary transfer units and primarily transfer the image on the photoconductor 7 onto an intermediate transfer belt 12, a secondary transfer roller 14 that serves as a secondary transfer unit and secondarily transfers the toner image that is transferred to the intermediate transfer belt 12 to the recording medium, and a belt cleaner 17 that serves as an intermediate transferor cleaning unit and cleans the outer circumferential surface of the intermediate transfer belt 12 are arranged.

The intermediate transfer belt 12 is stretched by a drive roller 15 and at least one driven roller 16 and goes round as the drive roller 15 rotates on the axis. The multiple primary transfer rollers 13 are arranged so as to press the intermediate transfer belt 12 against the multiple photoconductors 7. Due to such a configuration, a plurality of primary transfer nips at which the images on the multiple photoconductors 7 are transferred onto the intermediate transfer belt 12 are formed at a plurality of contact portions where the intermediate transfer belt 12 contacts the multiple photoconductors 7. On the other hand, the secondary transfer roller 14 is arranged so as to contact a portion of the intermediate transfer belt 12 that is wrapped around the drive roller 15. Due to such a configuration, a secondary transfer nip at which the image on the intermediate transfer belt 12 is transferred onto the recording medium is formed at a contact portion where the intermediate transfer belt 12 contacts the secondary transfer roller 14 through the recording medium.

In the recording medium supply unit 3, a sheet tray 18 that serves as a recording medium storage and stores a sheet of paper P as a recording medium, a paper feeding roller pair 19 that serves as a recording medium feeding unit and feeds the sheet of paper P from the sheet tray 18, a timing roller pair 20 that serves as a recording medium conveyance unit and conveys the sheets of paper P that are fed by the paper feeding roller pair 19 to the secondary transfer nip at a prescribed timing are arranged. Note also that the recording medium may be, for example, an overhead projector (OHP) sheet, an OHP film, and a fabric in addition to a sheet of paper. In addition to plain paper, the sheet of paper may be other various kinds of sheets including, for example, a cardboard, a postcard, an envelope, thin paper, coated paper, art paper, tracing paper, and Japan paper whose surface is uneven and not very smooth.

In the fixing device 4, a fixing device 21 that serves as a fixing unit and fixes an image onto the sheet of paper P is arranged. The fixing device 21 includes, for example, a fixing roller 22 that serves as a fixing unit and is heated by a heat source such as a heater, and a pressure roller 23 that serves as a pressurizer and is pressed against the fixing roller 22 with predetermined level of pressure to form a fixing nip.

In the recording medium ejection unit 5, an output roller pair 24 that serves as a recording medium ejection unit and ejects the sheet of paper P that is conveyed through the fixing device 21 to the outside of the apparatus, and an output tray 25 that serves as a recording medium container in which the sheet of paper P ejected through the output roller pair 24 is held are arranged.

The controller 30 is in charge of the overall control of the printer, and performs image processing on the image data input from, for example, a personal computer (PC) or a reading device such as a scanner. The image formation controller 40 controls the image-forming operation performed by each element of the printer such as the image forming unit 1, the transfer unit 2, the recording medium supply unit 3, the fixing device 4, and the recording medium ejection unit 5, under control of the controller 30.

In addition to the above multiple elements as described above, the printer according to the present embodiment is provided with a plurality of toner cartridges 26 that serve as a granular material container in which a granular material, i.e., toner in the present embodiment, used to form an image is stored. Each one of the multiple toner cartridges 26 stores the toner of the color same as the color of the toner inside the corresponding one of the multiple developing devices 9, and the toner cartridge 26 supplies the developing device 9 with the toner when the amount of the toner inside the corresponding one of the multiple developing devices 9 runs below a predetermined amount. Furthermore, the printer according to the present embodiment is provided with a waste-toner container 27, which serves as another granular material container, in addition to the toner cartridge 26. The waste-toner container 27 stores the waste toner retrieved by the belt cleaner 17 or the photoconductor cleaner 10.

As illustrated in FIG. 1, the printer according to the present embodiment is provided with a cover 101 used to open and close the upper side of a housing 100 of the image forming apparatus. The cover 101 is pivotable in the up-and-down directions around a rotation axis 103 provided for the housing 100 of the image forming apparatus. Under the cover 101, a container holder 102 is arranged in which four toner cartridges 26 can be stored in a removable manner. The container holder 102 is pivotable in the up-and-down directions around another rotation axis 104 provided for the housing 100 of the image forming apparatus.

In the present embodiment, the processing unit 6IR that uses IR toner is arranged on the downstream side in the direction of travel of the intermediate transfer belt 12 and the processing units 6Y, 6M, and 6C that use color toner are arranged on the upstream side such that IR toner image composed of IR toner, which may be referred to as a special-toner image, will be formed on the recording medium side compared with the color toner images composed of Y color toner, M color toner, and C color toner. In other words, the Y toner image, the M toner image, the C toner image, and the IR toner image are stacked on top of each other on the intermediate transfer belt 12 in the order listed from the belt side. However, when the secondarily transfer is complete, the IR toner image, the C toner image, the M toner image, and the Y toner image are stacked on top of each other in the order listed from the recording medium side.

As described above, an IR toner image is formed on the recording medium side compared with the color toner images. Due to such a configuration, the IR toner image is hidden by the color toner images as desired, and the visibility of the IR toner image decreases. Moreover, the invisibility of the image formed by IR toner can easily be secured. However, no limitation is indicated thereby, and the relative positions of the IR processing unit 61R that uses IR toner and the processing units 6Y, 6M, and 6C that use color toner may be adjusted as desired. As described as above, when the positions at which these processing units 6Y, 6M, 6C, and 61R are installed are configured to be interchangeable with each other, the position of the processing unit that uses IR toner can be changed as desired.

The basic operation of the printer according to the present embodiment is described below. When an image forming operation is started, the multiple photoconductors 7 are driven to rotate, and the surfaces of the photoconductors 7 are evenly charged to a predetermined polarity by the multiple charging rollers 8. Subsequently, the exposure devices 11 irradiate the electrically-conductive surfaces of the multiple photoconductors 7 with laser beams based on the image data input from, for example, a personal computer (PC) or a reading device such as a scanner. Accordingly, an electrostatic latent image is formed.

The latent image that is formed on each one of the photoconductors 7 is a latent image that is formed based on the single-color image data obtained by separating a desired full-color image into a plurality of color images of Y, M, and C. More specifically, the input image data is converted and decomposed into YCM color data to generate single-color image data using a color conversion and decomposition table with which the color data of the input image, for example, red, green, and blue (RGB) or yellow, cyan, and magenta (YCM), is converted and decomposed into color data (yellow, cyan, or magenta (YCM)) for the printer according to the present embodiment, and the multiple exposure devices 11 that correspond to the yellow, cyan, and magenta (YCM) colors, respectively, form the latent image of each color on the corresponding one of the multiple photoconductors 7, based on the image data in YCM colors.

In the present embodiment, the infrared (IR) image data is generated based on, for example, the additional information included in the input image data and the additional information added by the printer according to the present embodiment. The additional information included in the input image data may be the information added by an application installed onto a personal computer, or may be the information added by the printer driver installed onto a personal computer. The exposure device 11 for IR images forms an IR latent image, based on the IR image data, on one of the photoconductors 7 that corresponds to the processing unit 6IR that uses IR toner.

The multiple latent image of Y color, C color, M color, or IR that is formed on each one of the photoconductors 7 is supplied with toner from the corresponding one of the developing devices 9, and is developed as toner image of Y color, C color, M color, or IR. The toner images that are formed on the multiple photoconductors 7 are sequentially transferred onto the rotating intermediate transfer belt 12 by superimposing multiple images on top of one another. More specifically, once one of the toner images on the photoconductor 7 is conveyed and reaches the position of the primary transfer nip, the toner images on the multiple photoconductors 7 are sequentially transferred onto the intermediate transfer belt 12 by the transfer electric field formed as a predetermined level of voltage is applied the primary transfer roller 13. Due to the configurations and structure as described above, a full-color toner image (visible image) composed of Y color toner, C color toner, and M color toner and an IR toner image (invisible image) composed of IR toner are formed on the surface of the intermediate transfer belt 12. Some of the toner that failed to be transferred to the intermediate transfer belt 12 and remains on each one of the photoconductors 7 is removed by the corresponding one of the photoconductor cleaners 10.

Once the image-forming operation starts, the paper feeding roller 19 starts rotating, and the sheet of paper P is fed from the sheet tray 18. The timing roller pair temporarily halts the sheet P fed through the paper feeding roller pair 19. Thereafter, the timing roller pair 20 starts rotating at a prescribed timing and starts conveying the sheet of paper P to the secondary transfer nip at a timing when the full color toner image formed on the intermediate transfer belt 12 reaches the secondary transfer nip.

When the sheet of paper P is transferred onto the secondary transfer nip, a predetermined level of voltage is applied the secondary transfer roller 14. Accordingly, a transfer electric field is formed at the secondary transfer nip, and the toner image on the intermediate transfer belt 12 is transferred onto the sheet P all at once due to the electric field formed at the secondary transfer nip. In so doing, the residual toner that is left on the intermediate transfer belt 12 is removed by the belt cleaner 17.

The sheet of paper P is then conveyed to the fixing device 21, and the toner image is fixed to the sheet of paper P as heated and pressurized by the fixing roller 22 and the pressure roller 23. Then, the sheet of paper P is ejected to the outside of the apparatus by the output roller pair 24, and is placed on the output tray 25.

The above description relates to an image forming operation when a full-color image is formed on a recording medium. However, no limitation is indicated thereby, and an image may be formed using any one of the four processing units 6Y, 6M, 6C, and 61R. Alternatively, an image may be formed using two or three of the four processing units 6Y, 6M, 6C, and 61R.

An IR image is not completely colorless but is in pale yellow under visible radiation. For this reason, if the IR image exists on a recording medium on its own, there is some concern that such an IR image could visually be recognized under visible light, and the invisibility of the IR image may not sufficiently be secured.

Figure 2A:
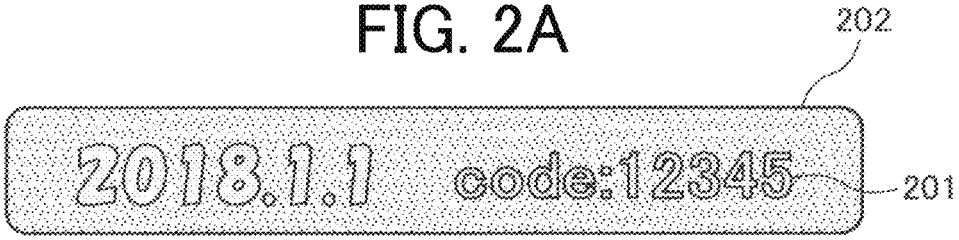
FIG. 2A is a diagram illustrating how an infrared (IR) image and a jamming image appear when these images are irradiated with infrared light, according to an embodiment of the present disclosure.

FIG. 2A is a diagram illustrating an IR image and a jamming image irradiated with infrared light, according to the present embodiment.

Figure 2B:
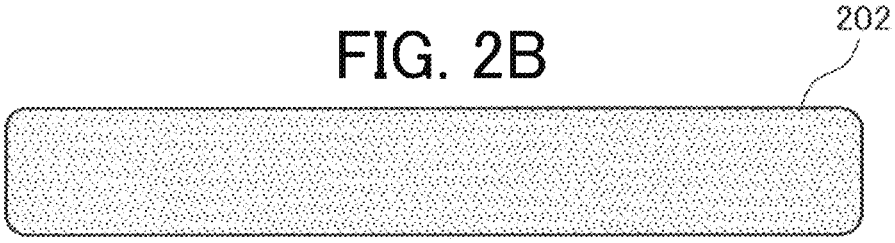
FIG. 2B is a diagram illustrating how a jamming image appears under visible light, according to an embodiment of the present disclosure.

FIG. 2B is a diagram illustrating a state of a jamming image under visible light, according to the present embodiment.

In order to handle such a situation, in the present embodiment as illustrated in FIG. 2A and FIG. 2B, a jamming image 202 that serves as a prevention image and prevents the viewability of an IR image 201 under visible light can be formed around the IR image 201 on a recording medium. More specifically, whether or not the jamming image 202 is to be formed can be selected through the operation of, for example, the control panel provided for the apparatus and a personal computer (PC) installed with a printer driver. When it is determined that the jamming image 202 is be formed, the controller 30 controls the image formation controller 40 to form the jamming image 202 around the IR image 201 in an automatic manner. The area of the jamming image 202 may manually be set through the operation of the PC installed with printer driver software. For example, the IR image 201 that is formed on the recording medium, e.g., "2018.1.1. code: 12345" as illustrated in FIG. 2A, is displayed when manual setting is chosen through the operation of the printer driver software of the PC, and the forming area of the jamming image 202 may manually be specified.

The jamming image 202 is generated such that its color will be the same as the color of the IR image 201 under visible light, using at least one of the Y color toner, the C color toner, and the M color toner. More specifically, the jamming image 202 is formed such that the difference in gloss value between the IR image 201 and the jamming image 202 will be equal to or smaller than 10% and the color difference ΔE between the IR image 201 and that the jamming image 202 will be equal to or smaller than 6.5. Due to such a configuration, as illustrated in FIG. 2B, the IR image 201 is blended into the jamming image 202, and the IR image 201 cannot visually be recognized easily under visible light. When the jamming image 202 is to be formed using only a single color toner, it is desired that the toner of Y color be used. This is because the IR image 201 cannot visually be recognized easily when the image is formed by Y color that is most inconspicuous on a sheet of paper. By contrast, when the jamming image is irradiated with infrared light, the IR image emits light and reproduces color. As a result, as illustrated in FIG. 2A, the IR image can visually be recognized easily.

In the present embodiment, the color difference ΔE can be obtained as follows. The condition of 2-degree viewing field of the CIE Standard Illuminant D50 that serves as a light source is adopted, and the color of each one of the IR image 201 and the jamming image 202 is measured using a spectrophotometric colorimeter (X-Rite eXact-scan). As a result, the value of the color difference ΔE can be calculated and obtained based on the multiple measured values. Note also that the color difference ΔE is calculated based on the definition described in Japanese Industrial Standards (JIS) Z 8105 2073.

The above gloss value is measured and obtained using a glossmeter PG-1, which is produced by Nippon Denshoku Industries, Co. Ltd., at the glancing angle of 60 degrees, according to a method of measuring the gloss value of a specular surface defined in Japanese Industrial Standards (JIS) Z8741.

Figure 3A:
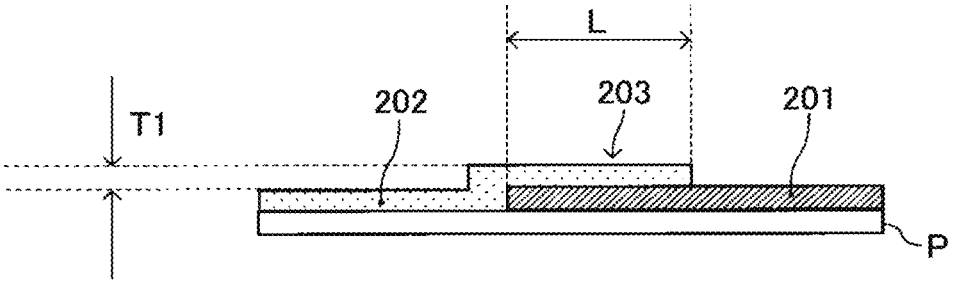
FIG. 3A is a sectional view of an IR image and a jamming image when the density of adherence of toner of a jamming image at an overlapping region is equivalent to the density of adherence of toner at the other regions, according to an embodiment of the present disclosure.

FIG. 3A is a sectional view of the IR image 201 and the jamming image 202 when the density of adherence of toner of the jamming image at an overlapping region 203 is equivalent to the density of adherence of toner at the other regions, according to the present embodiment.

Figure 3B:
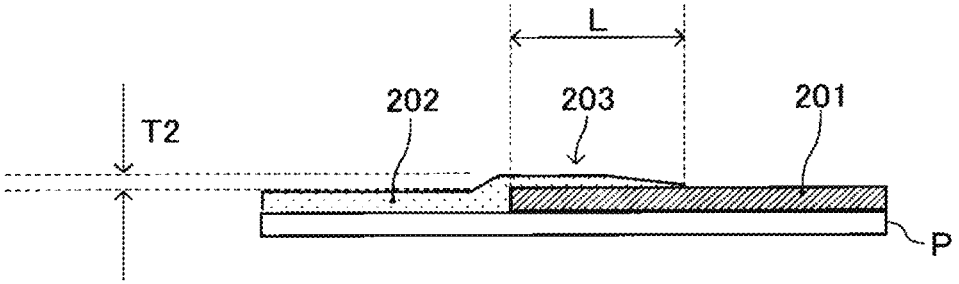
FIG. 3B is a sectional view of an IR image and a jamming image when the density of adherence of toner of the jamming image at an overlapping region is smaller than the density of adherence of toner at the other regions, according to an embodiment of the present disclosure.

FIG. 3B is a sectional view of the IR image 201 and the jamming image 202 when the density of adherence of toner of the jamming image 202 at the overlapping region 203 is smaller than the density of adherence of toner at the other regions, according to the present embodiment.

There is some concern that the jamming image 202 may be displaced from the IR image 201 due to, for example, the decentering of the multiple photoconductors. When such decentering occurs, a bare region may appear in which no toner adheres between the IR image 201 and the jamming image 202. Under such conditions, there is some concern that an edge face of the IR image 201 may visually be recognized under visible light due to the color difference between the IR image 201 and the white surface of the recording medium at such a bare region. In such cases, the invisibility of the IR image 201 is impaired.

In order to handle such a situation, in the present embodiment, as illustrated in FIG. 3A and FIG. 3B, the jamming image 202 is formed such that the jamming image 202 will overlap with an edge face of the IR image 201. Due to such a configuration, even if the jamming image 202 is slightly displaced from the IR image 201, a bare region between the IR image 201 and the jamming image 202 can be prevented. Moreover, an edge face of the IR image 201 can be prevented from being visually recognized under visible light, and the invisibility of the IR image 201 under visible light can be secured as desired.

In the present embodiment, the width L of the overlapping region 203 in which the IR image 201 is overlaid with the jamming image 202 is between 50 to 100 μm. However, no limitation is intended thereby, and the width L of the overlapping region 203 may be equal to or wider than 100 μm. Alternatively, the jamming image 202 may be formed so as to cover the entirety of the IR image 201.

However, as illustrated in FIG. 3A, the overlapping region 203 in which an edge face of the IR image 201 is overlaid with the jamming image 202 tends to swell by about T1 micrometers (μm) compared with the other portions of the image. As a result, for example, the visible light may be reflected differently between the above overlapping region 203 and its surrounding image area. For this reason, there is some concern that the unevenness at the overlapping region 203 in comparison to the surrounding area is visually recognized, and the IR image 201 is visually recognized due to such unevenness.

In order to handle such a situation, in the present embodiment, as illustrated in FIG. 3B, the density of adherence of toner of the jamming image 202 at the overlapping region 203 with the IR image 201 is made smaller than the density of adherence of toner at the other regions. Due to such a configuration, the swelling portion at the overlapping region 203 in which an edge face of the IR image 201 is overlaid with the jamming image 202 can be as small as T2 micrometers (μm), and the swelling portion of the overlapping region 203 can be reduced. Note that T2 is smaller than T1, and for example, T2 is equal to or smaller than 10 μm. Due to such a configuration, the unevenness at the overlapping region 203 in which an edge face of the IR image 201 is overlaid with the jamming image 202 in comparison to the surrounding area can be prevented from being visually recognized under visible light, and the invisibility of the IR image 201 can be secured as desired.

Figure 4:
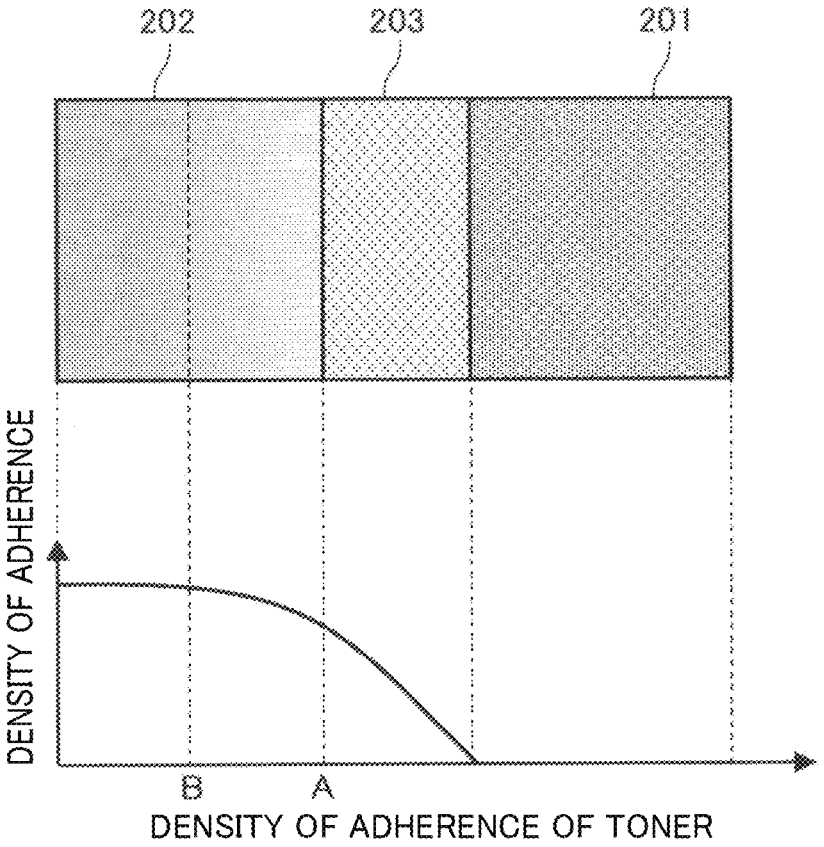
FIG. 4 is a graph illustrating the density of adherence of toner at varying positions of a jamming image, according to an embodiment of the present disclosure.

FIG. 4 is a graph illustrating the density of adherence of toner at varying positions of the jamming image 202, according to the present embodiment.

The density of adherence of toner indicates the density of the toner that is adhered per each unit of dimension, and the measurement unit of $mg/cm^2$ is adopted in the present embodiment. Note also that the density of adherence of toner may also be regarded as the amount of adhered toner or the mass of the adhered toner per each unit of dimension. In the present disclosure, the density of toner is indicated in which the toner is so thin that the bare region to which no toner adheres can be seen through. For example, the number of layers of stacked toner is one or less.

The density of adherence of toner can be obtained as follows. Firstly, a magnified image with the power of two-hundred times is obtained using an optical electron microscope, and the magnified image is binarized. Then, the ratio of the number of pixels of the toner-adhered region to the number of all the pixels is calculated based on the magnified and binarized image.

As illustrated in FIG. 4, in the embodiments of the present disclosure, the density of adherence of toner of the jamming image 202 at an overlapping region 203 is gradually reduced toward an edge face of the prevention image 202. In the present embodiment, the density of adherence of toner of the jamming image 202 starts to be reduced from a position B as illustrated in FIG. 4, which is slightly outside and away from the overlapping region 203. As described above, the swelling portion at an edge face A of the IR image 201, i.e., the boundary region between the overlapping region 203 and the jamming image 202, can be reduced due to such a configuration in which the density of adherence of toner of the jamming image 202 starts to be reduced from a position slightly outside and away from the overlapping region 203, and the unevenness at an edge face of the IR image 201 can be made inconspicuous and less outstanding under visible light.

As the exposure value of the multiple exposure devices 11 is gradually reduced from the position B as illustrated in FIG. 4, which is slightly outside and away from the overlapping region 203, the density of adherence of toner can gradually be reduced from the position B toward an edge face of the jamming image 202.

Alternatively, the conditions for primary transfer may be changed to cause dust particles intentionally. By so doing, the density of adherence of toner on the jamming image 202 can gradually be reduced from the position B toward an edge face of the jamming image 202.

Further, a known error-diffusion method such as dithering may be adopted, and the printing rate is gradually be reduced by image processing from the position B toward an edge face of the jamming image 202. By so doing, the density of adherence of toner on the jamming image 202 can gradually be reduced from the position B toward an edge face of the jamming image 202.

Alternatively, the exposure value may gradually be reduced, and the amount of adhered toner is gradually reduced. When such a method is adopted to reduce the density of adherence of toner on the jamming image 202 in a gradual manner, there is some concern that the relation between the amount of adhered toner and the exposure value changes depending on, for example, the environment. Further, there is some concern that the density of adherence of toner at the overlapping region 203 cannot be changed to a desired density of adherence in a stable manner. In order to stabilize the density of adherence of toner, the image-forming condition needs to be adjusted as follows. A sensor that senses the amount of adhered toner is arranged to form a test image of toner at prescribed time intervals, and the amount of toner adhered to the formed test image is detected by the sensor that senses the amount of adhered toner. By so doing, the image-forming condition can be adjusted as desired.

When the above conditions for primary transfer are adopted in which the density of adherence of toner at the overlapping region 203 is reduced by causing dust particles intentionally, the dust particles that are caused by transferring process tend to affect the other images that are formed by toner whose color is same as the color of the toner used to form the jamming image 202. Further, the conditions of dust particle may differ due to, for example, the environment, and there is some concern that the density of adherence of toner at the overlapping region 203 cannot be changed to a desired density of adherence in a stable manner.

By contrast, the above method in which the density of adherence of toner on the jamming image 202 is gradually reduced by image processing from the position B toward an edge face of the jamming image 202 is desirable because the density of adherence of toner can be reduced to a desired density of adherence in a stable manner compared with cases in which the density of adherence of toner is reduced by manipulating the exposure value or the image-forming conditions such as the conditions for primary transfer.

Figure 5:
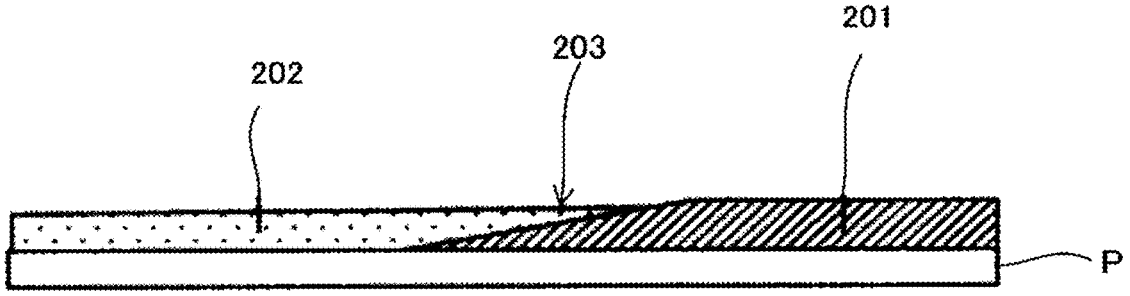
FIG. 5 is a sectional view of an IR image and a jamming image, where the density of adherence of toner of both the IR image and the jamming image is reduced at an overlapping region, according to an embodiment of the present disclosure.

FIG. 5 is a sectional view of the IR image 201 and the jamming image 202, where the density of adherence of toner of both the IR image 201 and the jamming image 202 is reduced at the overlapping region 203, according to the present embodiment.

The density of adherence of toner of the IR image 201 at the overlapping region 203 in which the IR image 201 is overlaid with the jamming image 202 around its edge face may be reduced within a range in which the IR image 201 is not affected in any way. Alternatively, as illustrated in FIG. 5, the density of adherence of toner of both the 1R image 201 and the jamming image 202 may be reduced at the overlapping region 203. Due to such a configuration, the swelling portion of the overlapping region 203 can virtually be eliminated, and the invisibility of the IR image 201 under visible light can further be improved.

Figure 6:
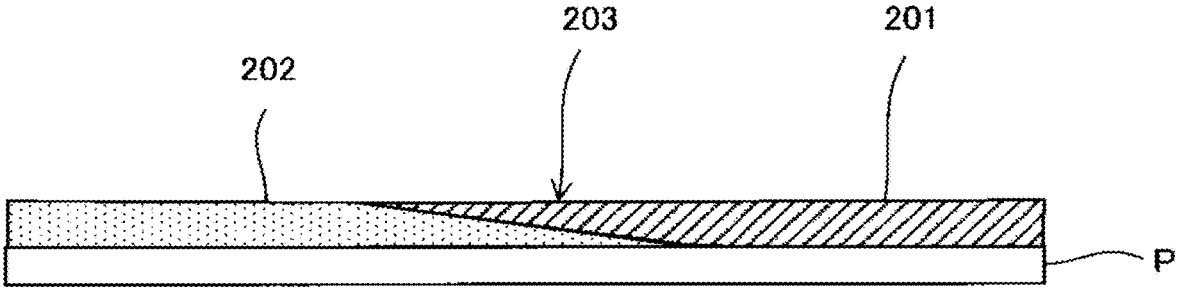
FIG. 6 is a sectional view of an IR image and a jamming image, where an edge face of the jamming image is overlaid with the IR image, according to an embodiment of the present disclosure.

FIG. 6 is a sectional view of the 1R image 201 and the jamming image 202, where the IR image 201 overlaps with an edge face of the jamming image 202, according to the present embodiment.

As illustrated in FIG. 6, an edge face of the jamming image 202 may be overlaid with the IR image 201. When the processing unit 6IR that uses IR toner is arranged on the more downstream side than the processing unit 6Y, 6M, and 6C in the direction where the surface of the intermediate transfer belt 12 travels, as illustrated in FIG. 6, an edge face of the jamming image 202 may be overlaid with the IR image 201.

Each kind of image as illustrated in FIG. 5 and FIG. 6 may be defined as follows depending on the amount of IR toner. The IR image 201 may be defined as an image with a relatively large amount of IR toner, and the jamming image 202 may be defined as an image with a relatively small amount of IR toner. The above overlapping region 203 may be defined as a mixed image with a not very small and not very large amount of IR toner. In other words, the overlapping region 203 contains both IR toner and color toner in a mixed manner.

Figure 9:
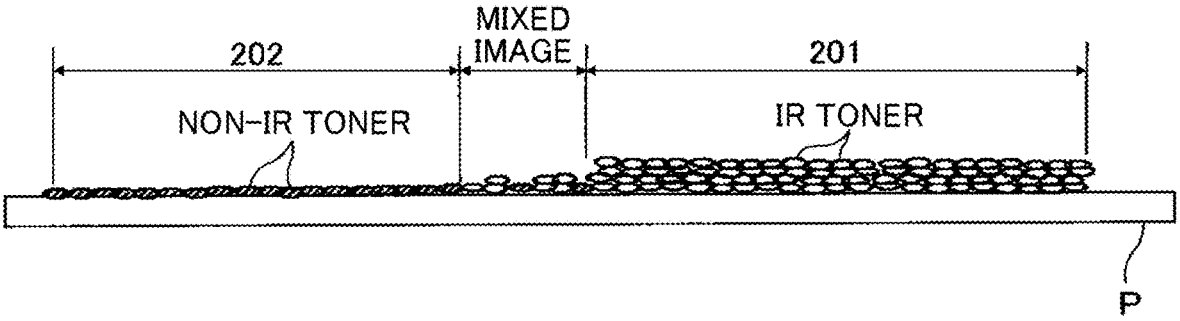
FIG. 9 is a sectional view of the IR image and the jamming image on a mixed image around an IR image where IR toner and normal color toner do not overlap with one another, according to an embodiment of the present disclosure.

FIG. 9 is a sectional view of the IR image 201 and the jamming image 202 on a mixed image around the IR image 201 where IR toner and normal color toner do not overlap with one another, according to the present embodiment.

As illustrated in FIG. 9, it is not always necessary for IR toner and color toner to overlap with one another on a mixed image, which corresponds to the overlapping region in the above embodiment.

Alternatively, the jamming image 202 may be formed so as to cover the entirety of the IR image 201. In the present embodiment, the density of adherence of toner of the jamming image 202 at an overlapping region 203 with the IR image 201 is reduced. Due to such a configuration, the increment of the amount of toner adhered to the overlapping region can efficiently be controlled. When a method is adopted in which the printing rate at an overlapping region is reduced by image processing and the density of adherence of toner is reduced, the increment of the image density at an overlapping region is also controlled. Due to such a configuration, even if the jamming image 202 is formed so as to cover the entirety of the IR image 201, it is not likely that a fixation failure occurs or the image density at a portion of the IR image increases For this reason, the jamming image 202 may be formed so as to cover the entirety of the IR image 201.

In the above-described embodiment of the present disclosure, the IR image 201 is formed using clear or transparent IR toner. However, no limitation is indicated thereby, and the IR image may be formed using colored IR toner that is visually be recognized easily under visible light. For example, K toner that contains carbon black that serves as an infrared light absorber may be used as colored IR toner. In such a configuration, the IR image 201 is in black, and a black jamming image 202 is formed using Y color toner, M color toner, and C color toner that do not contain any infrared light absorber such as carbon. Alternatively, a coloring material may be added to the above clear or transparent IR toner, and the above clear or transparent IR toner may be used as colored IR toner.

The jamming image 202 whose color is same as the color of the IR image is formed around the colored IR image 201 that is composed of colored IR toner. As a result, the IR image 201 is blended into the jamming image 202, and the IR image 201 cannot visually be recognized easily.

Figure 7:
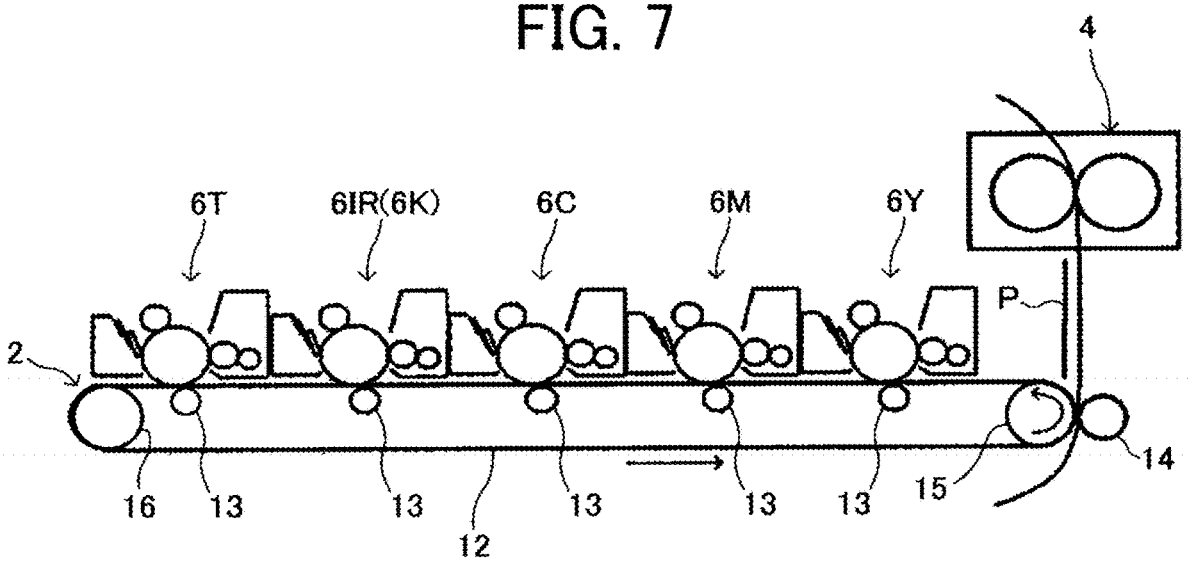
FIG. 7 is a diagram illustrating an image forming apparatus according to a modification of the above embodiments of the present disclosure.

FIG. 7 is a diagram illustrating an image forming apparatus according to a modification of the above embodiments of the present disclosure.

The image forming apparatus according to a modification of the above embodiments of the present disclosure as illustrated in FIG. 7 is provided with a processing unit 6T that forms an image using clear toner that serves as a special-light irresponsive image forming material and never absorbs infrared light or reproduces color when irradiated with infrared light. The processing unit 6T is arranged on the more downstream side than the processing unit 61R in the direction where the surface of the intermediate transfer belt 12 travels.

Due to such a configuration, clear toner may be used to form the jamming image 202, and the difference in gloss value between the IR image 201 and the jamming image 202 under visible light can further be reduced. As a result, the degree of invisibility of the IR image 201 under visible light can further be increased.

In particular, there is some concern that the difference in gloss value between the IR image 201 and the jamming image 202 cannot be reduced to 10% or less simply by Y color toner, M color toner, and C color toner when the color tone of the IR toner is low under visible light and the amount of non-IR toner to reproduce the color tone tends to be very small in the first place. When IR toner with low color tone is to be used, it is desired that a processing unit 6T be provided and that the jamming image be formed using clear toner and at least one of Y color toner, M color toner, and C color toner. By so doing, the difference in gloss value between the IR image 201 and the jamming image 202 can be reduced to a value equal to or smaller than 10%, and the color of the jamming image 202 can be made the same as the color of the IR image 201.

Figure 8:
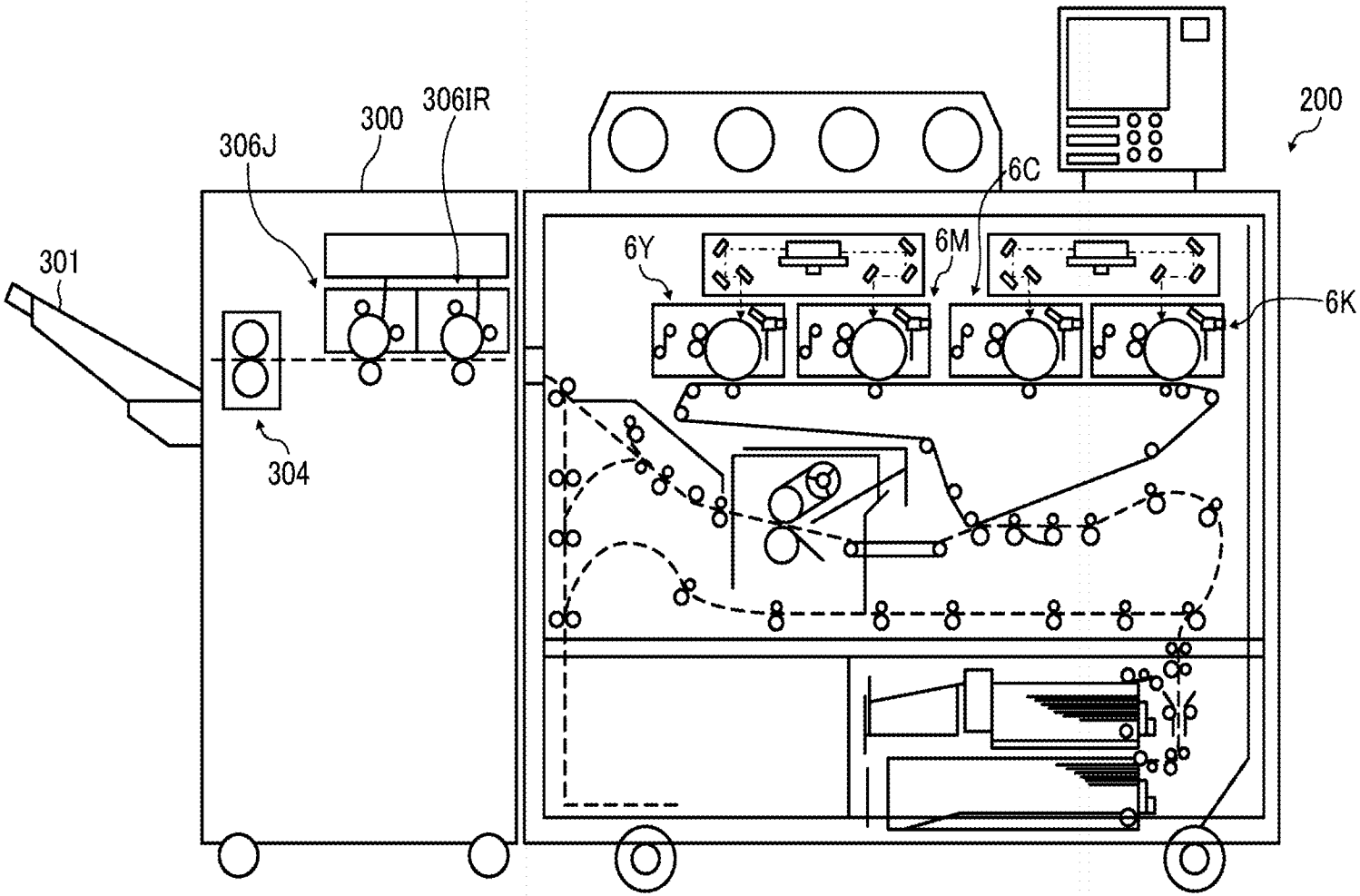
FIG. 8 is a diagram illustrating an image forming apparatus according to another modification of the above embodiments of the present disclosure.

FIG. 8 is a diagram illustrating an image forming apparatus according to another modification of the above embodiments of the present disclosure.

The image forming apparatus according to another modification of the above embodiments of the present disclosure as illustrated in FIG. 8 includes a full-color image forming apparatus 200 and an IR image forming apparatus 300 that forms an IR image.

The IR image forming apparatus 300 includes an IR processing unit 306IR that is optionally installed in the full-color image forming apparatus 200 to form the IR image 201 using IR toner, and a jamming processing unit 306J that forms the jamming image 202 using jamming toner that serves as special-light irresponsive image forming material. The color of such jamming toner is same as the color of the IR toner under visible light, and such jamming toner never absorbs infrared light or reproduces color when irradiated with infrared light. Moreover, the jamming toner according to the present embodiment is adjusted such that its color will be same as the color of the IR toner under visible light, using clear toner and at least one of Y color toner, M color toner, C color toner, and K color toner.

In the present embodiment, the sheet of paper P on which an image is formed by the full color image forming apparatus 200 is conveyed to the IR image forming apparatus 300. Then, an IR toner image is formed at a predetermined position of the sheet of paper P, and a jamming toner image is formed around the IR image. Then, the IR toner image and the jamming toner image are fixed onto the sheet of paper P by the fixing device 304, and the sheet of paper P is ejected to the output tray 301.

In the image forming apparatus as illustrated in FIG. 1 or FIG. 7, the fixing condition needs to be determined such that the images other than the jamming image and the IR image will be formed as desired. However, in the present modification of the above embodiments as illustrated in FIG. 8, the fixing condition of the fixing device 304 can be determined without regard for the images other than the jamming image and the IR image. For this reason, for example, the fixing condition of the fixing device 304 can optimally be determined such that there will be no difference in gloss value between the jamming image 202 and the IR image 201. Moreover, in the configuration as illustrated in FIG. 8, the transfer condition in which dust particles are caused by transferring process may be selected when a jamming toner image is to be transferred to a sheet of paper. Even if such a transfer condition is selected, the other images are not affected. When an IR image is to be formed in the configuration as illustrated in FIG. 1 and FIG. 7, the processing unit 6K that uses K color toner needs to be replaced with the processing unit 6IR that uses IR toner. However, such replacement is no longer necessary in the configuration as illustrated in FIG. 8 and saving in time can be achieved.

The embodiments described above are given as an example, and unique advantageous effects are achieved for each of the first to sixteenth modes given below.

First Mode

An image forming apparatus forms, on a recording medium, a special-light responsive image such as the IR image 201 including an image forming material including a special-light responsive image forming material such as IR toner that reacts to special light such as infrared light other than visible light and a special-light irresponsive image including the special-light responsive image forming material. For example, the special-light irresponsive image is composed of Y, M, and C toner. In the image forming apparatus according to the first mode of the present disclosure, the special-light responsive image forming material of the special-light irresponsive image is less than the special-light responsive image forming material of the special-light responsive image. In the first mode of the present disclosure as described above, the special-light irresponsive image is used as a prevention image such as the jamming image 202 that prevents visibility of the special-light responsive image, and at least a portion of one of the special-light irresponsive image and the special-light responsive image is overlaid on top of another one of the special-light irresponsive image and the special-light responsive image. Moreover, the density of adherence of the image forming material over the portion where at least one of the prevention image and the special-light responsive image is overlaid on top of the other one of the prevention image and the special-light responsive image is smaller than the density of adherence of the image forming material at a portion where the one of the prevention image and the special-light responsive image is not overlaid on top of the other one of the prevention image and the special-light responsive image.

As a prevention image such as the jamming image 202 is formed so as to be overlaid on top of a special-light responsive image such as the IR image 201, the appearance of a bare region between the special-light responsive image and the prevention image can be prevented even if the prevention image is slightly displaced from the special-light responsive image when the prevention image is formed over the special-light responsive image. Due to such a configuration according to the first mode of the present disclosure, the special-light responsive image can be blended into the prevention image as desired under visible light, and the visibility of the special-light responsive image can be prevented as desired.

Moreover, in the first mode of the present disclosure as described above, the density of adherence of the image forming material such as toner at the overlapping region 203 where the at least one of the prevention image and the special-light responsive image is overlaid with the other one of the prevention image and the special-light responsive image is made smaller than the density of adherence of the image forming material such as toner at the overlapping region 203 where the at least one of the prevention image and the special-light responsive image is not overlaid with the other one of the prevention image and the special-light responsive image. Due to such a configuration according to the first mode of the present disclosure, compared with the configuration in which the density of adherence of the image forming material such as toner at the overlapping region 203 where the at least one of the prevention image and the special-light responsive image is overlaid with the other one of the prevention image and the special-light responsive image is same as the density of adherence of the image forming material such as toner at the overlapping region 203 where the at least one of the prevention image and the special-light responsive image is not overlaid with the other one of the prevention image and the special-light responsive image, the swelling portion of the overlapping region of the two images can be reduced. As a result, the visual recognition of a special-light responsive image under visible light due to the unevenness caused by the swelling portion of the overlapping region of the two images can be prevented.

Second Mode

In the image forming apparatus according to the first mode of the present disclosure, the swelling level of the overlapping region of the two images with reference to the non-overlapping region is equal to or less than 10 μm.

Due to such a configuration, as described above in the embodiment of the present disclosure, the unevenness at the overlapping region 203 between a special-light responsive image such as the IR image 201 and a prevention image such as the jamming image 202 in comparison to the surrounding area can be prevented from being visually recognized under visible light, and the invisibility of the special-light responsive image can be secured as desired.

Third Mode

In the image forming apparatus according to the first or second mode of the present disclosure, the area in which the density of adherence is small is broader than the area of the portion in which the at least one of the prevention image and the special-light responsive image is overlaid with the other one of the special-light irresponsive image and the special-light responsive image.

Due to such a configuration, as described above with reference to FIG. 4, the swelling portion at the boundary region between the overlapping region 203 and a prevention image such as the jamming image 202 can be reduced, and the unevenness at an edge face of a special-light responsive image such as the IR image 201 can be made inconspicuous and less outstanding under visible light.

Fourth Mode

In the image forming apparatus according to any one of the first to third modes of the present disclosure, the density of adherence of the image forming material over the portion where the at least one of the special-light irresponsive image and the special-light responsive image is overlaid on top of the other one of the special-light irresponsive image and the special-light responsive image is gradually reduced toward an edge face of the one of the special-light irresponsive image and the special-light responsive image.

Due to such a configuration according to the fourth mode of the present disclosure, the unevenness at the overlapping region 203 between a special-light responsive image such as the IR image 201 and a prevention image such as the jamming image 202 in comparison to the surrounding area can be prevented from being visually recognized under visible light, and the invisibility of the special-light responsive image can be secured as desired.

Fifth Mode

In the image forming apparatus according to any one of the first to fourth modes of the present disclosure, the printing rate at the overlapping region 203 where at least one of the special-light responsive image such as the IR image 201 and the prevention image such as the jamming image 202 is overlaid with the other one of the prevention image and the special-light responsive image is made smaller than the printing rate at an region where the at least one of the special-light responsive image such as the IR image 201 and the prevention image such as the jamming image 202 is not overlaid with the other one of the prevention image and the special-light responsive image.

Due to such a configuration according to the fifth mode of the present disclosure, as described above in the embodiment of the present disclosure, the density of adherence of, for example, the density of adherence of toner at the overlapping region 203 can be reduced. Alternatively, the density of adherence may be reduced by image processing. By so doing, the density of adherence of toner at the overlapping region 203 may be reduced to a desired density of adherence in a stable manner.

Sixth Mode

In the image forming apparatus according to any one of the first to fifth modes of the present disclosure, the density of adherence of both the special-light responsive image such as the IR image 201 and the prevention image such as the jamming image 202 is reduced over the overlapping region.

Due to such a configuration according to the sixth mode of the present disclosure, as described above with reference to FIG. 5, the swelling portion of the overlapping region 203 can further be reduced, and the visual recognition of a special-light responsive image such as an IR image due to the swelling portion of the overlapping region 203 can further be prevented.

Seventh Mode

In the image forming apparatus according to any one of the first to sixth modes of the present disclosure, a prevention image and a special-light responsive image are formed such that these two kinds of images will be overlaid on top of each other only at an edge face of a prevention image such as the jamming image 202 or an area within a prescribed range from the edge face of the prevention image and an edge face of a special-light responsive image such as the IR image 201 or an area within a prescribed range from the edge face of the special-light responsive image. Due to such a configuration according to the seventh mode of the present disclosure, the consumption of toner can be reduced, and the appearance of a bare region between the special-light responsive image and the prevention image can be prevented.

Eighth Mode

In the image forming apparatus according to the seventh mode of the present disclosure, the density of adherence of an overlapping region in which a special-light responsive image such as the IR image 201 and a prevention image such as the jamming image 202 overlaid on top of each other is gradually reduced toward an edge face of the special-light responsive image, and the density of adherence of the overlapping region in which the special-light responsive image sand the prevention image overlaid on top of each other is gradually reduced toward an edge face of the prevention image.

Due to such a configuration according to the eighth mode of the present disclosure, as described above with reference to FIG. 5 and FIG. 6, the swelling portion of the overlapping region 203 can further be reduced, and the visual recognition of a special-light responsive image such as an IR image due to the swelling portion of the overlapping region 203 can further be prevented.

Ninth Mode

An image forming apparatus forms, on a recording medium, a special-light responsive image such as the IR image 201 including an image forming material including a special-light responsive image forming material such as IR toner that reacts to special light such as infrared light other than visible light and a special-light irresponsive image including the special-light responsive image forming material. For example, the special-light irresponsive image is composed of Y, M, and C toner. In the image forming apparatus according to the ninth mode of the present disclosure, the special-light responsive image forming material of the special-light irresponsive image is less than the special-light responsive image forming material of the special-light responsive image. According to the ninth mode of the present disclosure, the special-light irresponsive image is used as a prevention image such as the jamming image 202 that prevents visibility of the special-light responsive image, and the prevention image and the special-light responsive image are formed such that these two kinds of images will be overlaid on top of each other only at an edge face of the prevention image or an area within a prescribed range from the edge face of the prevention image and an edge face of a special-light responsive image or an area within a prescribed range from the edge face of the special-light responsive image.

Due to such a configuration according to the ninth mode of the present disclosure, the consumption of toner can be reduced, and the appearance of a bare region between the special-light responsive image and the prevention image can be prevented.

Tenth Mode

In the image forming apparatus according to any one of the first to ninth modes of the present disclosure, the color difference ΔE between a special-light responsive image such as the IR image 201 and a prevention image such as the jamming image 202 under visible light is equal to or smaller than 6.5.

Due to such a configuration according to the tenth mode of the present disclosure, as described above in the embodiment of the present disclosure, the color of a prevention image such as the jamming image 202 can be made substantially the same as the color of a special-light responsive image such as an IR image under visible light. Accordingly, the visibility of the special-light responsive image under visible light can be prevented as desired by the jamming image 202.

Eleventh Mode

In the image forming apparatus according to any one of the first to tenth modes of the present disclosure, the difference in gloss value between a special-light responsive image such as the IR image 201 and a prevention image such as the jamming image 202 is equal to or smaller than 10%. Due to such a configuration according to the eleventh mode of the present disclosure, as described above in the embodiment of the present disclosure, the visual recognition of the IR image 201 under visible light due to the difference in gloss value between a special-light responsive image such as the IR image 201 and a prevention image such as the jamming image 202 can be prevented.

Twelfth Mode

In the image forming apparatus according to any one of the first to eleventh modes of the present disclosure, the special light is infrared light.

Due to such a configuration according to the twelfth mode of the present disclosure, a special-light responsive image such as an IR image can be read and obtained by performing irradiation with infrared light.

Thirteenth Mode

A method of forming an image, the method comprising: forming, on a recording medium, a special-light responsive image such as the IR image 201 including an image forming material including a special-light responsive image forming material such as IR toner that reacts to special light such as infrared light other than visible light and a special-light irresponsive image including the special-light responsive image forming material. For example, the special-light irresponsive image is composed of Y, M, and C toner. In the method according to the thirteenth mode of the present disclosure, the special-light responsive image forming material of the special-light irresponsive image is less than the special-light responsive image forming material of the special-light responsive image. In the method according to the thirteenth mode of the present disclosure, the special-light irresponsive image is used as a prevention image such as the jamming image 202 that prevents visibility of the special-light responsive image, and at least a portion of one of the special-light irresponsive image and the special-light responsive image is overlaid on top of another one of the special-light irresponsive image and the special-light responsive image. Moreover, in the method according to the thirteenth mode of the present disclosure, the density of adherence of the image forming material over the portion of the one of the special-light irresponsive image and the special-light responsive image is smaller than density of adherence of the image forming material of the one of the special-light irresponsive image and the special-light responsive image at which the special-light irresponsive image and the special-light responsive image are not overlaid on top of one another.

Due to such a configuration according to the thirteenth mode of the present disclosure, an advantageous effect similar to the advantageous effect of the above first mode of the present disclosure can be achieved.

Fourteenth Mode

A method of forming an image, the method comprising: forming, on a recording medium, a special-light responsive image such as the IR image 201 including an image forming material including a special-light responsive image forming material such as IR toner that reacts to special light such as infrared light other than visible light and a special-light irresponsive image including the special-light responsive image forming material. For example, the special-light irresponsive image is composed of Y, M, and C toner. In the method according to the fourteenth mode of the present disclosure, the special-light responsive image forming material of the special-light irresponsive image is less than the special-light responsive image forming material of the special-light responsive image. According to the fourteenth mode of the present disclosure, the special-light irresponsive image is used as a prevention image such as the jamming image 202 that prevents visibility of the special-light responsive image, and the prevention image and the special-light responsive image are formed such that these two kinds of images will be overlaid on top of each other only at an edge face of the prevention image or an area within a prescribed range from the edge face of the prevention image and an edge face of a special-light responsive image or an area within a prescribed range from the edge face of the special-light responsive image.

Due to such a configuration according to the fourteenth mode of the present disclosure, an advantageous effect similar to the advantageous effect of the above ninth mode of the present disclosure can be achieved.

Fifteenth Mode

A method of forming an image, the method comprising: forming, on a recording medium, a special-light responsive image such as the IR image 201 including an image forming material including a special-light responsive image forming material such as IR toner that reacts to special light such as infrared light other than visible light and a special-light irresponsive image including the special-light responsive image forming material. For example, the special-light irresponsive image is composed of Y, M, and C toner. In the method according to the fifteenth mode of the present disclosure, the special-light responsive image forming material of the special-light irresponsive image is less than the special-light responsive image forming material of the special-light responsive image. Moreover, the method according to the fifteenth mode of the present disclosure comprises: forming a mixed image around the special-light responsive image, the mixed image including the special-light responsive image forming material less than the special-light responsive image forming material of the special-light responsive image and more than the special-light responsive image forming material of the special-light irresponsive image; and forming the special-light irresponsive image around the mixed image.

Due to such a configuration according to the fifteenth mode of the present disclosure, an advantageous effect similar to the advantageous effect of the above first mode of the present disclosure can be achieved.

Sixteenth Mode

A data recording medium such as the sheet of paper P on which an image is to be formed, the data recording medium comprising at least one of a character, a sign, a code, and an image formed by the method according to any one of the thirteenth mode to the fifteenth mode.

Due to such a configuration according to the sixteenth mode of the present disclosure, a data recording medium on which the visibility of the special-light responsive image is prevented as desired can be provided.

Note that numerous additional modifications and variations are possible in light of the above teachings. It is therefore to be understood that within the scope of the appended claims, the disclosure of the present disclosure may be practiced otherwise than as specifically described herein. For example, elements and/or features of different illustrative embodiments may be combined with each other and/or substituted for each other within the scope of this disclosure and appended claims.

Further, as described above, any one of the above-described and other methods of the present disclosure may be embodied in the form of a computer program stored on any kind of storage medium. Examples of storage media include, but are not limited to, flexible disks, hard disks, optical discs, magneto-optical discs, magnetic tape, nonvolatile memory cards, read only memory (ROM), etc. Alternatively, any one of the above-described and other methods of the present disclosure may be implemented by ASICs, prepared by interconnecting an appropriate network of conventional component circuits, or by a combination thereof with one or more conventional general-purpose microprocessors and/or signal processors programmed accordingly.

What is claimed is:

1. A method of forming an image, the method comprising forming, on a recording medium, a special-light responsive image that includes an image forming material including a special-light responsive image forming material that reacts to special light other than visible light and a special-light irresponsive image that includes an image forming material including the special-light responsive image forming material, wherein the special-light responsive image forming material of the special-light irresponsive image is less than the special-light responsive image forming material of the special-light responsive image, wherein the special-light irresponsive image is a prevention image that prevents visibility of the special-light responsive image, wherein the forming includes forming an overlaid portion in which at least a portion of one of the prevention image and the special-light responsive image is overlaid on top of another one of the prevention image and the special-light responsive image, and wherein density of adherence of the image forming material in the overlaid portion is smaller than density of adherence of the image forming material in a non-overlaid portion in which one of the prevention image and the special-light responsive image is not overlaid on top of another one of the prevention image and the special-light responsive image.

2. A method of forming an image, the method comprising forming, on a recording medium, a special-light responsive image that includes an image forming material including a special-light responsive image forming material that reacts to special light other than visible light and a special-light irresponsive image that includes an image forming material including the special-light responsive image forming material, wherein the special-light responsive image forming material of the special-light irresponsive image is less than the special-light responsive image forming material of the special-light responsive image, wherein the special-light irresponsive image is a prevention image that prevents visibility of the special-light responsive image, and wherein the prevention image and the special-light responsive image are overlaid on top of each other only at an edge face of the prevention image or an area within a prescribed range from the edge face of the prevention image and an edge face of the special-light responsive image or an area within a prescribed range from the edge face of the special-light responsive image.

3. A method of forming an image, the method comprising:

forming, on a recording medium, a special-light responsive image that includes an image forming material including a special-light responsive image forming material that reacts to special light other than visible light and a special-light irresponsive image that includes an image forming material including the special-light responsive image forming material;

forming a mixed image around the special-light responsive image, the mixed image including the special-light responsive image forming material less than the special-light responsive image forming material of the special-light responsive image and more than the special-light responsive image forming material of the special-light irresponsive image; and forming the special-light irresponsive image around the mixed image, wherein the special-light responsive image forming material of the special-light irresponsive image is less than the special-light responsive image forming material of the special-light responsive image.

4. A data recording medium comprising at least one of a character, a sign, a code, and an image formed by the method according to claim 1.

5. An image forming apparatus configured to form an image according to the method according to claim 1.

6. The image forming apparatus according to claim 5, wherein a swelling level of the overlaid portion with reference to the non-overlaid portion is equal to or less than 10 μm.

7. The image forming apparatus according to claim 5, wherein an area of at least one of the prevention image and the special-light responsive image in which the density of adherence of the image forming material is small is broader than an area of the overlaid portion.

8. The image forming apparatus according to claim 5, wherein the density of adherence of the image forming material in the overlaid portion is reduced toward an edge face of the one of the prevention image and the special-light responsive image.

9. The image forming apparatus according to claim 5, wherein a printing rate at the overlaid portion is smaller than a printing rate at the non-overlaid portion.

10. The image forming apparatus according to claim 5, wherein density of adherence of the image forming material in each one of the special-light responsive image and the prevention image is reduced in the overlaid portion.

11. The image forming apparatus according to claim 5, wherein the prevention image and the special-light responsive image are overlaid on top of each other only at an edge face of the prevention image or an area within a prescribed range from the edge face of the prevention image and an edge face of the special-light responsive image or an area within a prescribed range from the edge face of the special-light responsive image.

12. The image forming apparatus according to claim 11, wherein density of adherence of the image forming material of the special-light responsive image in the overlaid portion is reduced toward an edge face of the special-light responsive image, and wherein density of adherence of the image forming material of the prevention image in the overlaid portion is reduced toward an edge face of the prevention image.

13. The image forming apparatus according to claim 5, wherein a color difference between the special-light responsive image and the prevention image under visible light is equal to or smaller than 6.5.

14. The image forming apparatus according to claim 5, wherein a difference in gloss value between the special-light responsive image and the prevention image is equal to or smaller than 10%.

15. The image forming apparatus according to claim 5, wherein the special light is infrared light.

16. An image forming apparatus configured to form an image according to the method according to claim 2.

17. The image forming apparatus according to claim 16, wherein a color difference between the special-light responsive image and the prevention image under visible light is equal to or smaller than 6.5.

18. The image forming apparatus according to claim 16, wherein a difference in gloss value between the special-light responsive image and the prevention image is equal to or smaller than 10%.

19. The image forming apparatus according to claim 16, wherein the special light is infrared light.

20. An image forming apparatus configured to form an image according to the method according to claim 3, wherein the special light is infrared light, and wherein density of adherence of the image forming material of the special-light responsive image in the overlaid portion is reduced toward an edge face of the special-light responsive image.

* * * * *